US011471015B2

(12) United States Patent
Ward et al.

(10) Patent No.: US 11,471,015 B2
(45) Date of Patent: Oct. 18, 2022

(54) SURFACE CLEANING APPARATUS

(71) Applicant: TTI (Macao Commercial Offshore Limited), Macau (CN)

(72) Inventors: Matthew James Ward, West Midlands (GB); Richard David Waters, West Midlands (GB); Guy Lawrence Newsom, West Midlands (GB); Darren David Holmes, West Midlands (GB); Steven James Rogers, West Midlands (GB)

( * ) Notice: Subject to any disclaimer, the term of this patent is extended or adjusted under 35 U.S.C. 154(b) by 240 days.

(21) Appl. No.: 16/341,815

(22) PCT Filed: Oct. 12, 2017

(86) PCT No.: PCT/GB2017/053080
§ 371 (c)(1),
(2) Date: Apr. 12, 2019

(87) PCT Pub. No.: WO2018/069707
PCT Pub. Date: Apr. 19, 2018

(65) Prior Publication Data

US 2019/0313870 A1 Oct. 17, 2019

(30) Foreign Application Priority Data

Oct. 14, 2016 (GB) ..... 1617518

(51) Int. Cl.
*A47L 9/16* (2006.01)
*A47L 5/30* (2006.01)

(52) U.S. Cl.
CPC ..... *A47L 9/1666* (2013.01); *A47L 5/30* (2013.01); *A47L 9/1608* (2013.01); *A47L 9/1683* (2013.01)

(58) Field of Classification Search
CPC ..... A47L 9/16; A47L 9/1608; A47L 9/1616; A47L 9/1625; A47L 9/1633;
(Continued)

(56) References Cited

U.S. PATENT DOCUMENTS 4,142,541 A * 3/1979 Bossert ..... A23N 12/023 134/143
6,779,227 B2 8/2004 Lee
(Continued)

FOREIGN PATENT DOCUMENTS

AU 747056 A 6/2001
CN 100488433 C 5/2009
(Continued)

OTHER PUBLICATIONS

The American Heritage Dictionary - parallel (Year: 2022).*
(Continued)

*Primary Examiner* — Joseph J Hail
*Assistant Examiner* — Timothy Brady
(74) *Attorney, Agent, or Firm* — Michael Best & Friedrich LLP

(57) ABSTRACT

A surface cleaning apparatus is described including a housing supporting a suction source, a dirt collection container, and a cyclonic separation device for separating dirt from the airflow passing through the apparatus. The apparatus further includes a ducting member having an inlet in communication with an outlet from the cyclonic separation device and an outlet in communication with a passage leading to the suction source. The ducting member is removably connected to the housing or the dirt collection container and is rotatably moveable between locked and unlocked positions, and rotational movement of the ducting member from its unlocked position to its locked position aligns the outlet of the ducting member with the passage leading to the suction source.

28 Claims, 12 Drawing Sheets

(58) Field of Classification Search
CPC ..... A47L 9/1641; A47L 9/165; A47L 9/1658; A47L 9/1666; A47L 9/1675; A47L 9/1683; A47L 9/1691; A47L 9/10; A47L 9/102; A47L 9/104; A47L 9/106; A47L 9/22; A47L 9/24; A47L 9/242; A47L 9/244; A47L 9/00; A47L 5/06; A47L 5/22; A47L 5/24; A47L 5/26; A47L 5/30; B65D 51/248; B65D 55/026; B65D 55/02; B65D 2203/12; Y10T 403/20; F16B 1/0071; E05B 17/0091; E05B 41/00
USPC .... 15/327.7, 328, 353, 300.1, 344, 347–352
See application file for complete search history.

(56) References Cited

U.S. PATENT DOCUMENTS

| | | | | |
|---|---|---|---|---|
| 8,028,373 | B2 * | 10/2011 | Rowntree | A47L 9/322 15/347 |
| 8,146,201 | B2 * | 4/2012 | Conrad | A47L 7/0038 15/353 |
| 8,151,407 | B2 | 4/2012 | Conrad | |
| 8,359,705 | B2 * | 1/2013 | Conrad | A47L 5/24 15/328 |
| 8,590,102 | B2 | 11/2013 | Conrad | |
| 8,677,558 | B2 | 3/2014 | Conrad | |
| 8,752,239 | B2 | 6/2014 | Conrad | |
| 8,844,093 | B2 | 9/2014 | Conrad | |
| 8,869,344 | B2 | 10/2014 | Conrad | |
| 9,027,198 | B2 * | 5/2015 | Conrad | A47L 5/24 15/344 |
| 9,027,201 | B2 | 5/2015 | Conrad | |
| 9,066,643 | B2 | 6/2015 | Conrad | |
| 9,078,549 | B2 | 7/2015 | Conrad | |
| 9,084,522 | B2 | 7/2015 | Conrad | |
| 9,084,523 | B2 | 7/2015 | Conrad | |
| 9,084,524 | B2 | 7/2015 | Conrad | |
| 9,095,245 | B2 | 8/2015 | Conrad | |
| 9,119,513 | B2 * | 9/2015 | Conrad | A47L 5/36 |
| 9,119,514 | B2 | 9/2015 | Conrad | |
| 9,192,269 | B2 | 11/2015 | Conrad | |
| 9,301,666 | B2 * | 4/2016 | Conrad | A47L 9/1683 |
| 9,320,401 | B2 * | 4/2016 | Conrad | A47L 9/165 |
| 9,433,332 | B2 * | 9/2016 | Conrad | A47L 5/225 |
| 9,591,958 | B2 | 3/2017 | Conrad | |
| 10,080,471 | B2 * | 9/2018 | Reimer | A47L 5/24 |
| 2004/0163204 | A1 * | 8/2004 | Wang | A47L 9/0036 15/323 |
| 2004/0194437 | A1 * | 10/2004 | Macleod | A47L 9/20 55/467 |
| 2005/0210624 | A1 * | 9/2005 | Lammers | A47L 9/22 15/344 |
| 2006/0101609 | A1 * | 5/2006 | Oh | A47L 9/1463 15/327.2 |
| 2008/0104793 | A1 * | 5/2008 | Kang | A47L 9/0027 15/327.5 |
| 2008/0105278 | A1 | 5/2008 | Kang et al. | |
| 2008/0134460 | A1 * | 6/2008 | Conrad | A47L 9/0027 15/335 |
| 2008/0172821 | A1 * | 7/2008 | Kang | A47L 5/362 15/327.5 |
| 2008/0172992 | A1 | 7/2008 | Conrad | |
| 2009/0178568 | A1 * | 7/2009 | Yoo | A47L 9/20 55/459.1 |
| 2010/0192314 | A1 | 8/2010 | Otsuka et al. | |
| 2010/0299865 | A1 | 12/2010 | Conrad | |
| 2011/0146024 | A1 | 6/2011 | Conrad | |
| 2013/0091654 | A1 * | 4/2013 | Smith | A47L 9/1641 55/343 |
| 2013/0139348 | A1 | 6/2013 | Otsuka et al. | |
| 2014/0082882 | A1 * | 3/2014 | Kawamata | A47L 5/14 15/330 |
| 2014/0237757 | A1 * | 8/2014 | Conrad | A47L 9/1666 15/344 |
| 2014/0299297 | A1 | 10/2014 | Williams | |
| 2014/0366313 | A1 | 12/2014 | Conrad | |
| 2015/0208885 | A1 | 7/2015 | Conrad | |
| 2016/0113455 | A1 * | 4/2016 | Horvath | A47L 9/1691 15/344 |
| 2016/0198915 | A1 | 7/2016 | Conrad | |
| 2016/0198916 | A1 | 7/2016 | Conrad | |
| 2016/0242609 | A1 | 8/2016 | Conrad | |
| 2016/0287041 | A1 | 10/2016 | Conrad | |
| 2017/0071426 | A1 * | 3/2017 | Krebs | A47L 9/127 |

FOREIGN PATENT DOCUMENTS

| | | | |
|---|---|---|---|
| CN | 101657133 | A | 2/2010 |
| CN | 101662975 | A | 3/2010 |
| CN | 205251428 | U | 5/2016 |
| CN | 105935275 | A | 9/2016 |
| DE | 20202690 | U1 | 6/2002 |
| GB | 2457419 | B | 8/2009 |
| JP | 2015093021 | A | 5/2015 |
| WO | 2008070962 | A1 | 6/2008 |
| WO | 2008070963 | A1 | 6/2008 |
| WO | 2008070969 | A1 | 6/2008 |
| WO | 2008070972 | A1 | 6/2008 |
| WO | 2008070973 | A1 | 6/2008 |
| WO | 2014131104 | A1 | 9/2014 |
| WO | 2014131105 | A1 | 9/2014 |
| WO | 2014187471 | A1 | 11/2014 |
| WO | 2016065151 | A1 | 4/2016 |

OTHER PUBLICATIONS

International Search Report and Written Opinion for Application No. PCT/GB2017/053080 dated Feb. 9, 2018 (13 pages).
United Kingdom Patent Office Search Report for Application No. GB1617518.4 dated Feb. 27, 2017 (1 page).

* cited by examiner

SURFACE CLEANING APPARATUS

CROSS-REFERENCE TO RELATED APPLICATIONS

This application is a U.S. national phase of International Application No. PCT/GB2017/053080, filed Oct. 12, 2017, which claims priority to U.K. Patent Application No. 1617518.4, filed Oct. 14, 2016, the entire contents both of which are hereby incorporated by reference herein.

BACKGROUND

This invention relates to a surface cleaning apparatus.

SUMMARY

According to a first aspect of the invention we provide a surface cleaning apparatus including:

a housing supporting:
- a suction source;
- a dirt collection container; and
- a cyclonic separation device for separating dirt from the airflow passing through the apparatus; and a ducting member having an inlet in communication with an outlet from the cyclonic separation device and an outlet in communication with a passage leading to the suction source, wherein the ducting member is removably connected to the housing or the dirt collection container and is rotatably moveable between locked and unlocked positions, and wherein rotational movement of the ducting member from its unlocked position to its locked position aligns the outlet of the ducting member with the passage leading to the suction source.

Further features of the invention are set out in the appended claims.

BRIEF DESCRIPTION OF THE DRAWINGS

Embodiments of the invention will be set out below by way of example only with reference to the accompanying figures, of which.

DETAILED DESCRIPTION

Figure 1:
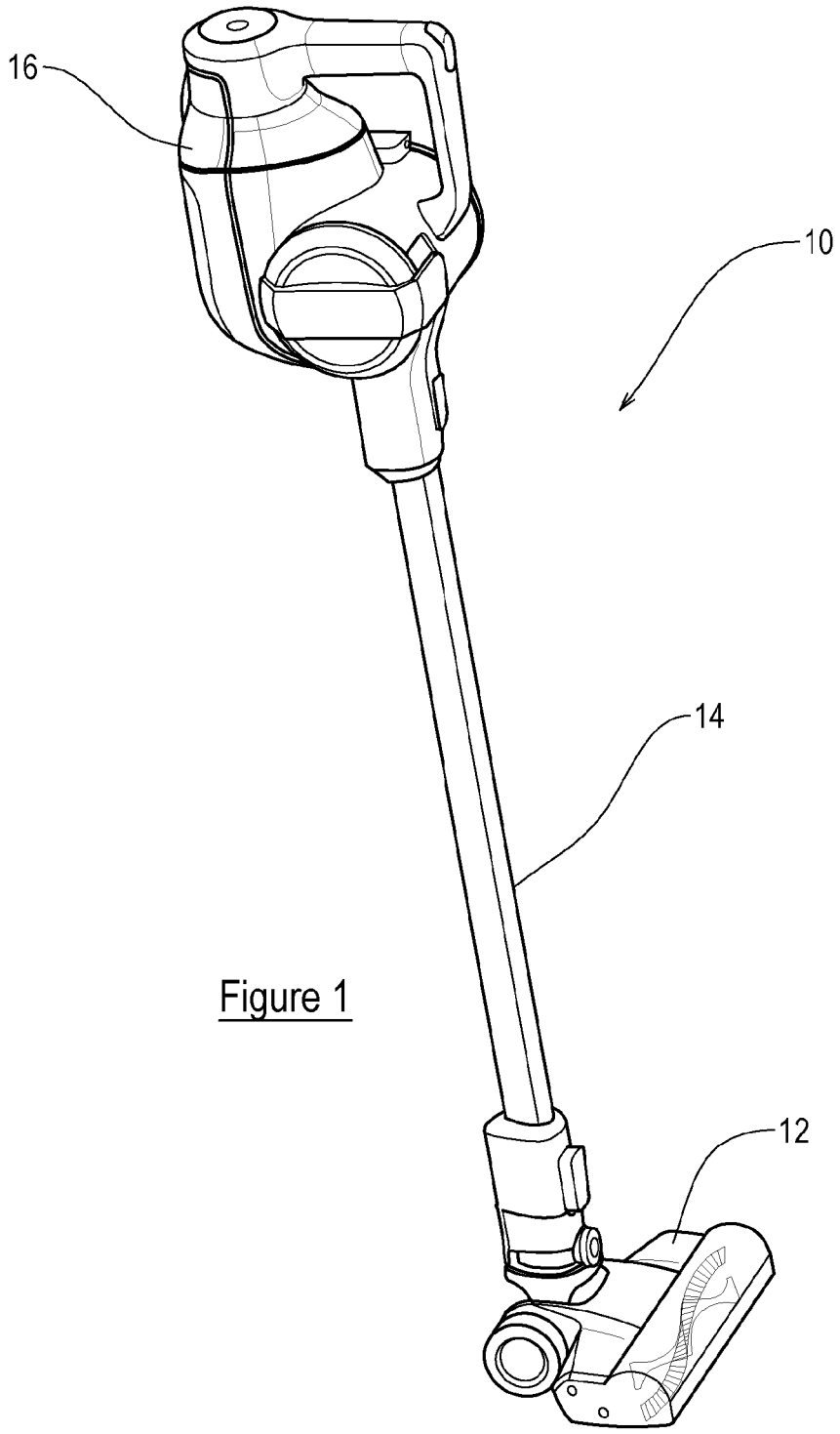
FIG. 1 is a perspective view of a surface cleaning apparatus.
Figure 2:
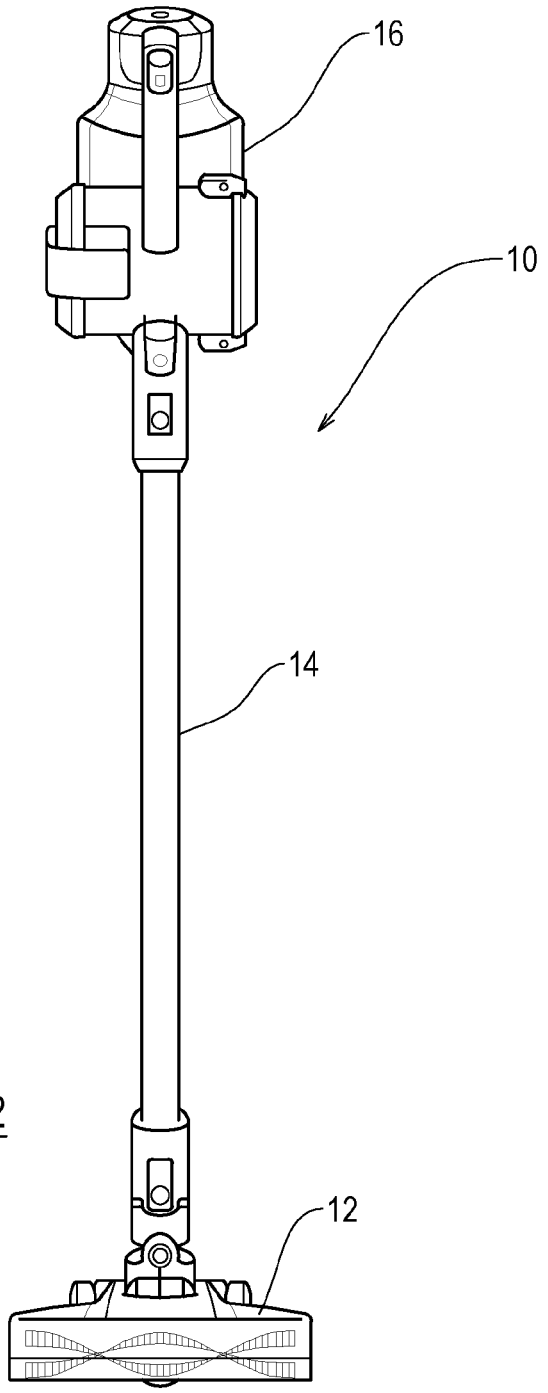
FIG. 2 is a front view of the apparatus of FIG. 1.
Figure 3:
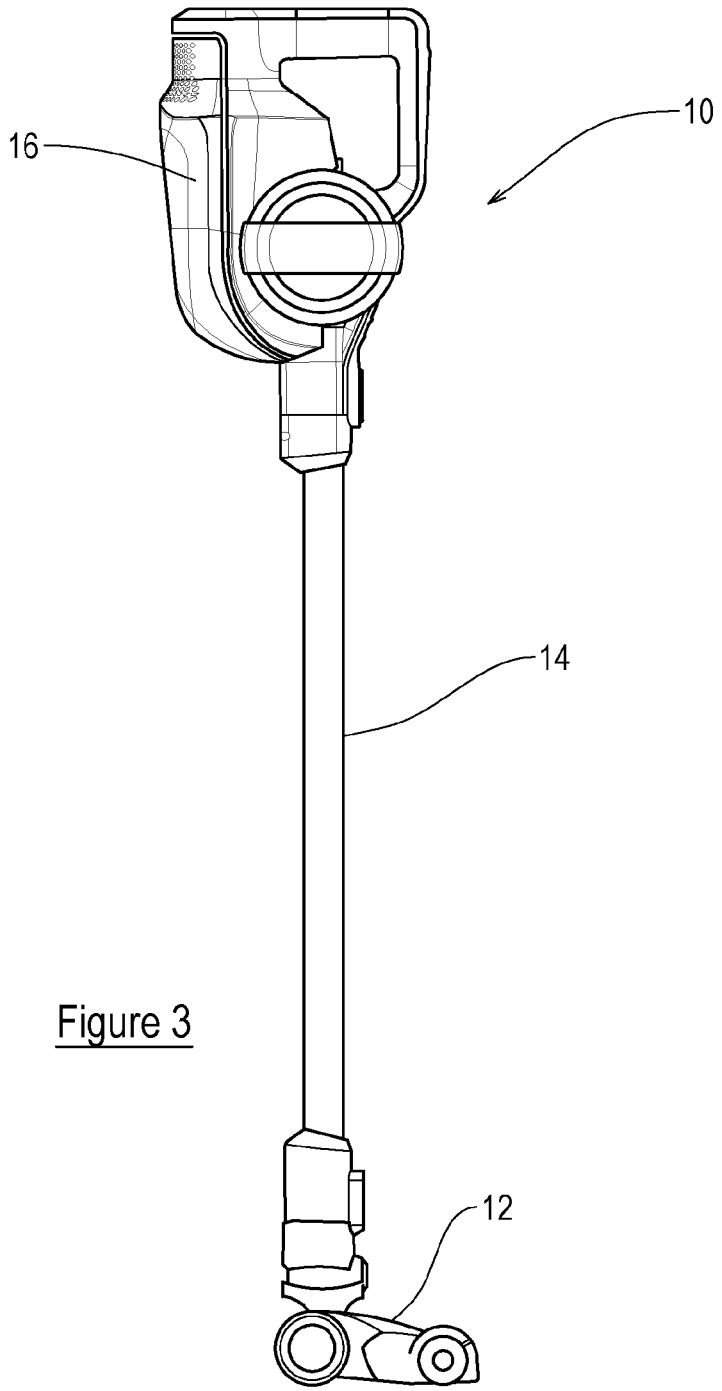
FIG. 3 is a side view of the apparatus FIG. 1.
Figure 4:
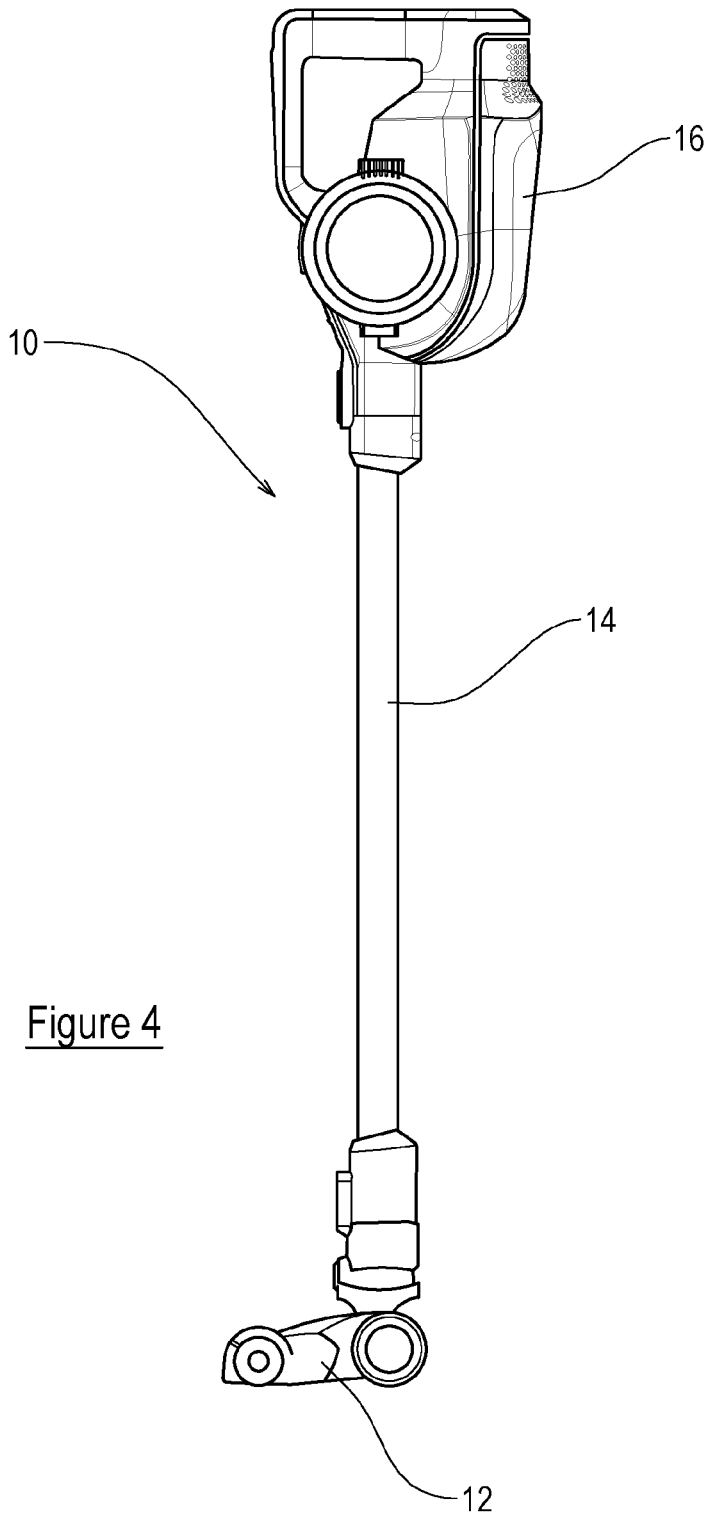
FIG. 4 is an opposite side view of the apparatus FIG. 1.

Referring to the figures, these show a surface cleaning apparatus 10 in accordance with the present invention. The apparatus 10 includes a floor head 12, a housing 16 and an elongate member 14 connecting the floor head 12 to the housing 16. The housing 16 in this example is operable as a handheld surface cleaning apparatus, commonly known as a hand vac, when the elongate member 14 and floor head 12 are not connected thereto. The housing 16 supports a suction source, a dirt container 18 and a cyclonic separator. In this example the suction source is an electric motor driving a rotatable fan, but any appropriate suction source may be used. All that is necessary is for the suction source to be able to draw air through the floor head 12 and elongate member 14 towards the dirt collection container.

In this example the housing 16 supports or contains a battery to provide electrical power to the suction motor and other components of the apparatus 10. In alternative embodiments, the apparatus 10 may be mains powered.

Whilst in the present embodiment the apparatus 10 includes a cyclonic separator to separate dirt from the air flowing through the apparatus 10, this is not essential. Indeed, embodiments are envisaged where the apparatus 10 includes a filter bag which collects dirt, or any other appropriate device to separate the dirt from the air.

The elongate member 14 includes a passage for carrying dirt-laden air from the floor head 12 to the dirt collection container 18. In this example the floor head 12 includes a motor for driving a rotatable floor agitating member or brush, so the elongate member 14 includes a further passage through which electrical cables may extend to provide an electric connection between the housing 16 and the motor in the floor head.

The floor head 12 is disconnectable from the elongate member 14, so that, for example, another tool can be connected to the free end of the elongate member 14. The elongate member 14 is also disconnectable from the housing 16, by way of a manually operated switch 17. This enables the housing 16 to be used as handheld surface cleaning apparatus, with the option of being able to connect another tool to the location from where the elongate member 16 is removed.

The housing 16 includes a handle for holding the apparatus 10, said handle including first 20 and second 21 user-graspable portions which are connected to each other substantially at right-angles. A first end of the first user-graspable portion 20 is connected to the housing 16 and extends generally rearwardly away therefrom and from the elongate member 14. A first end of the second user-graspable portion 21 is connected to the housing 16 and extends generally upwardly therefrom. Respective second ends of the first 20 and second 21 user-graspable portions are connected to each other. Essentially, the first 20 and second 21 user-graspable portions form a handle which is L-shaped and which provides two locations each of which is sized such that it can be grasped fully by a hand of a user. A device 22, e.g. a switch, for turning the apparatus "on" is positioned at the connection of the second ends of the first 20 and second 21 user-graspable portions to each other.

In the present embodiment, the dirt collection container 18 is generally cylindrical and has an elongate axis A. A pivotally moveable door 18*a* is provided at one end of the cylinder which enables a user to empty dirt collected within the container 18. Within the dirt collection container 18 is positioned a cyclonic separation device 19 which also has an elongate axis B coaxial with the axis A, the axis A being that about which dirt-laden air is caused to rotate as it passes through the apparatus 10. The elongate axis a is substantially horizontal in normal use. Whilst in this embodiment the elongate axes of the dirt collection container 18 and the cyclonic separation device 19 are coaxial or substantially coaxial, they need not be. They could, for example, be parallel and offset from each other or inclined relative to each other.

An end of the cylinder opposite the door 18*a* is closed by a generally cylindrical ducting member 70 having a peripheral wall 71 which extends into the cylinder of the dirt collection container 18. The ducting member 70 has an inlet 81 (covered by a filter 74) which receives air from an outlet 82 of the cyclonic separation device 19. The inlet 81 is in communication, via a passage 80, with an outlet 72 in the peripheral wall 71 which, in use, communicates with a passage 73 leading to the suction source 15. The ducting member 70 is removably connected to the dirt collection container 18 by a bayonet fitting or similar arrangement meaning that rotation of the ducting member 70 moves it between locked and unlocked positions.

Figure 9:
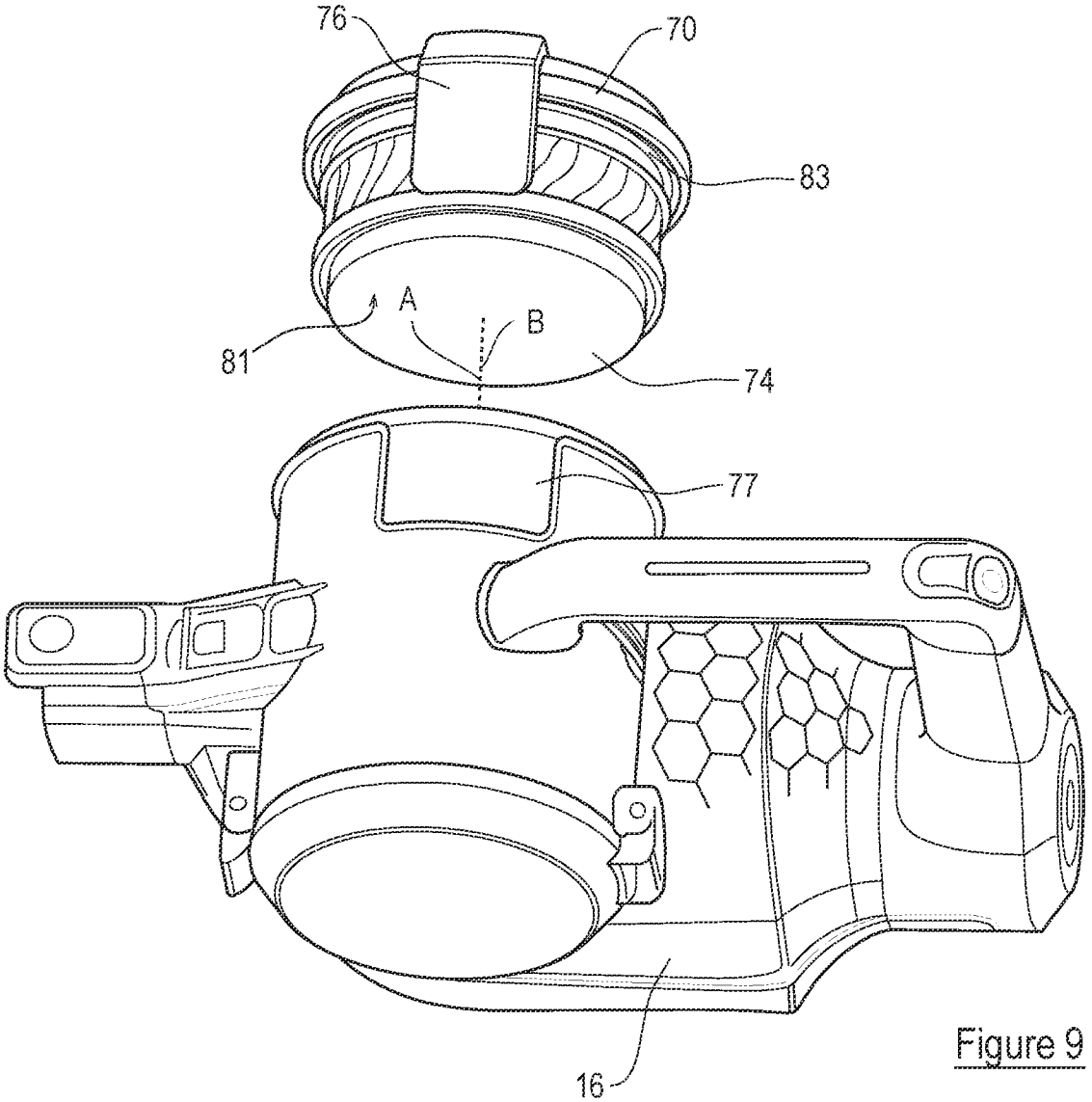
FIG. 9 is a yet further perspective view of the housing of FIG. 5 with a ducting member thereof show in exploded view.
Figure 10:
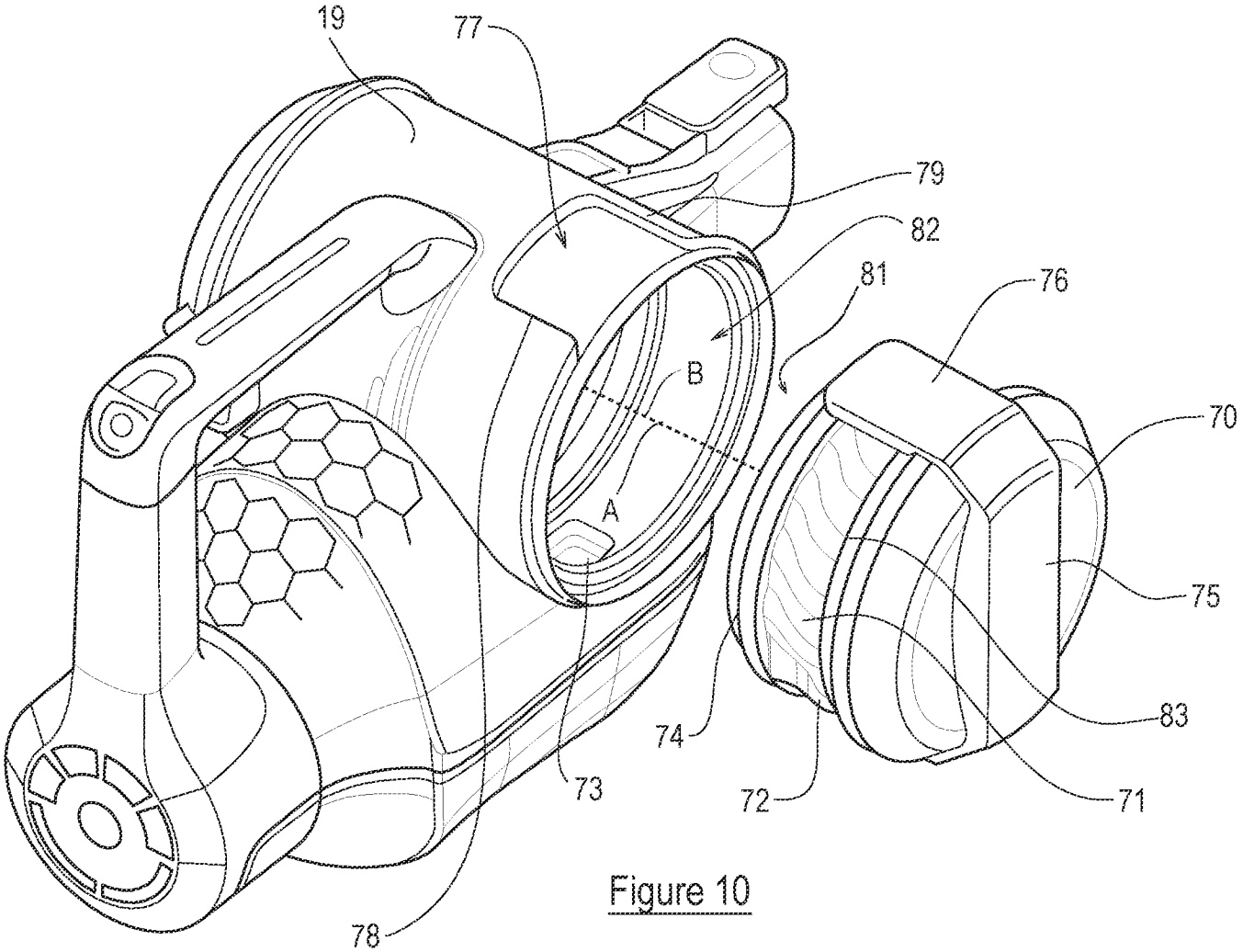
FIG. 10 is a yet further perspective view of the housing and ducting member from an opposite side to that of FIG. 9

The apparatus 10 included a pre-suction source filter 74, in the form of a disc-shaped filter (although other shapes of filter could be used), which is substantially cylindrical and circular in end view. The filter 74 is connected to the ducting member 70 such that when the ducting member 70 is removed from the remainder of the apparatus 10 the pre-suction source filter 74 comes away with the ducting member 70 (see FIG. 9).

This is advantageous to the user, because when the ducting member 70 is removed together with the pre-suction source filter 74, the user is able to view a dirty side of the filter 74 without touching the filter. The dirty side of the filter is the side that faces internally towards the door 18*a*.

In more detail, the pre-suction source filter 74 preferably includes a filter support, e.g. a peripheral rim or framework holding a filter medium. The ducting member 74 in this embodiment includes a formation, preferably a receiving formation, for holding (preferably by way of an interference fit) the pre-suction source filter 74 relative to the ducting member 70.

Figure 11:
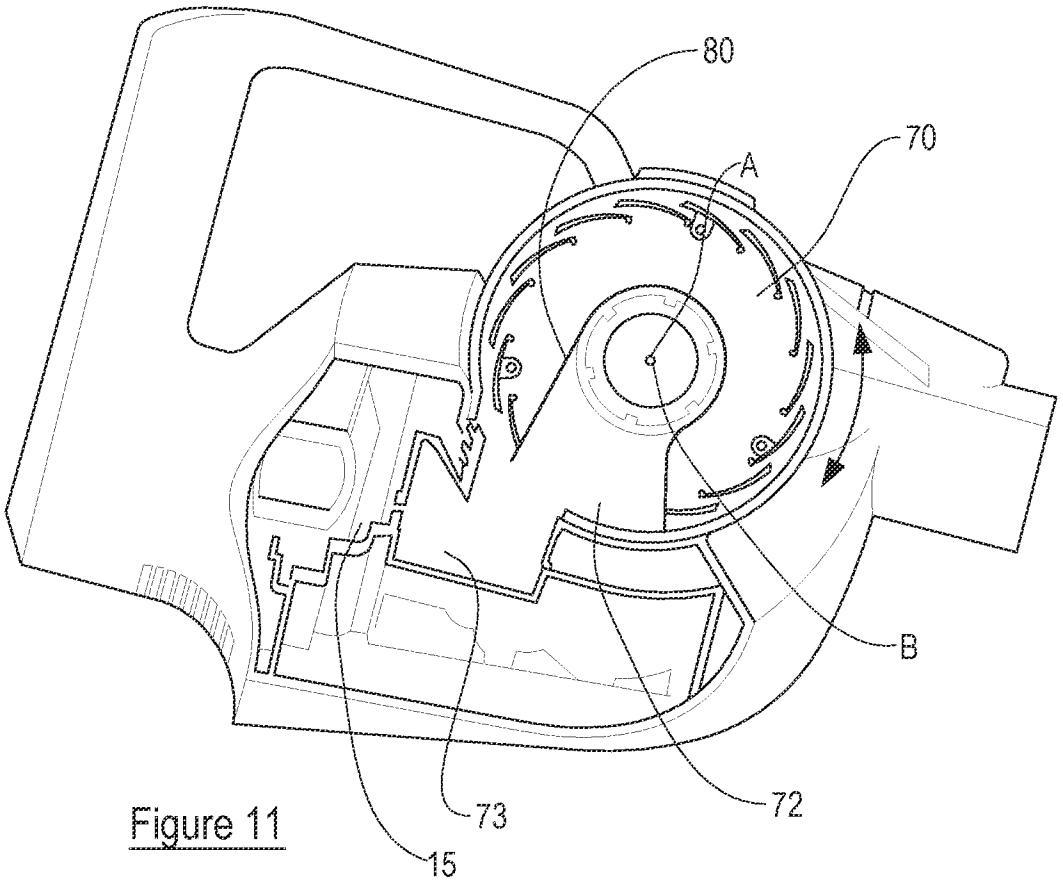
FIG. 11 is a cross-section side view of the housing.
Figure 12:
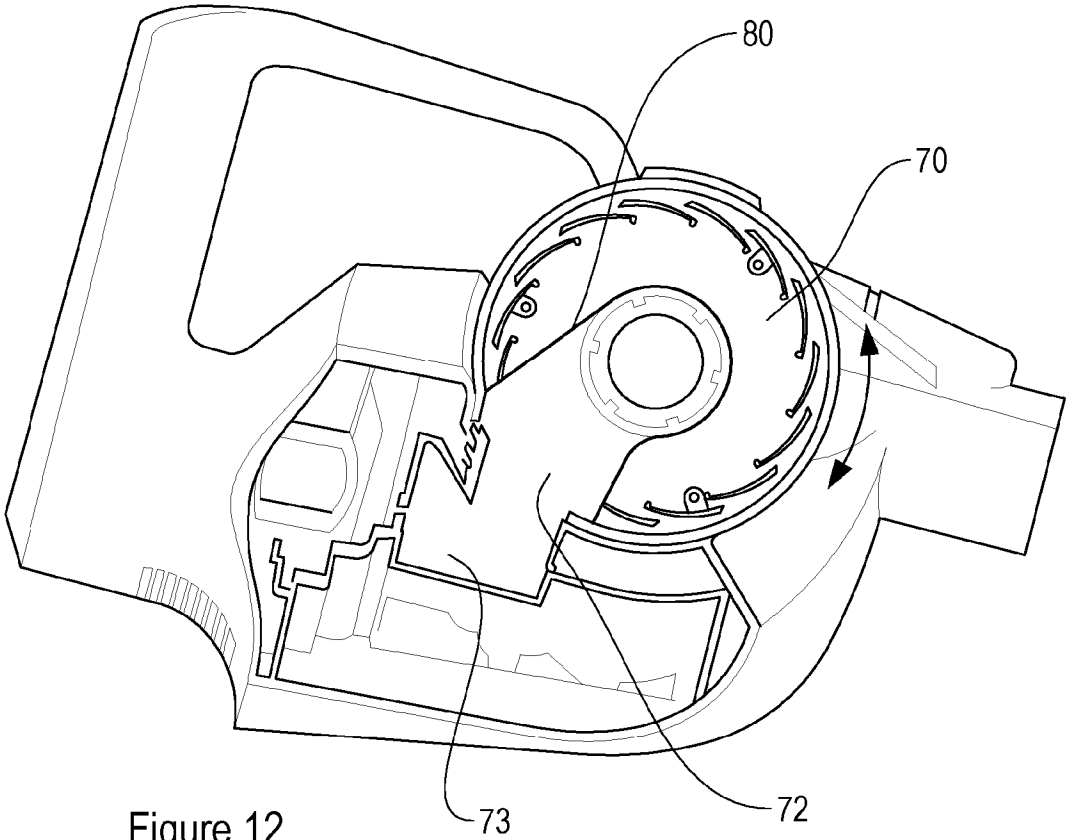
FIG. 12 is a further cross-section side view of the housing.

As mentioned previously, the ducting member 70 is rotatably moveable between locked and unlocked positions, such that rotational movement of the ducting member 70 from its unlocked position (see FIG. 11) to its locked position (see FIG. 12) aligns completely the outlet 72 of the ducting member 70 with the passage 73 leading to the suction source 15.

As will be appreciated, the ducting member 70 may include one or more seals 83 for providing an air-tight seal between the ducting member 70 and the dirt collection container 18.

Figure 5:
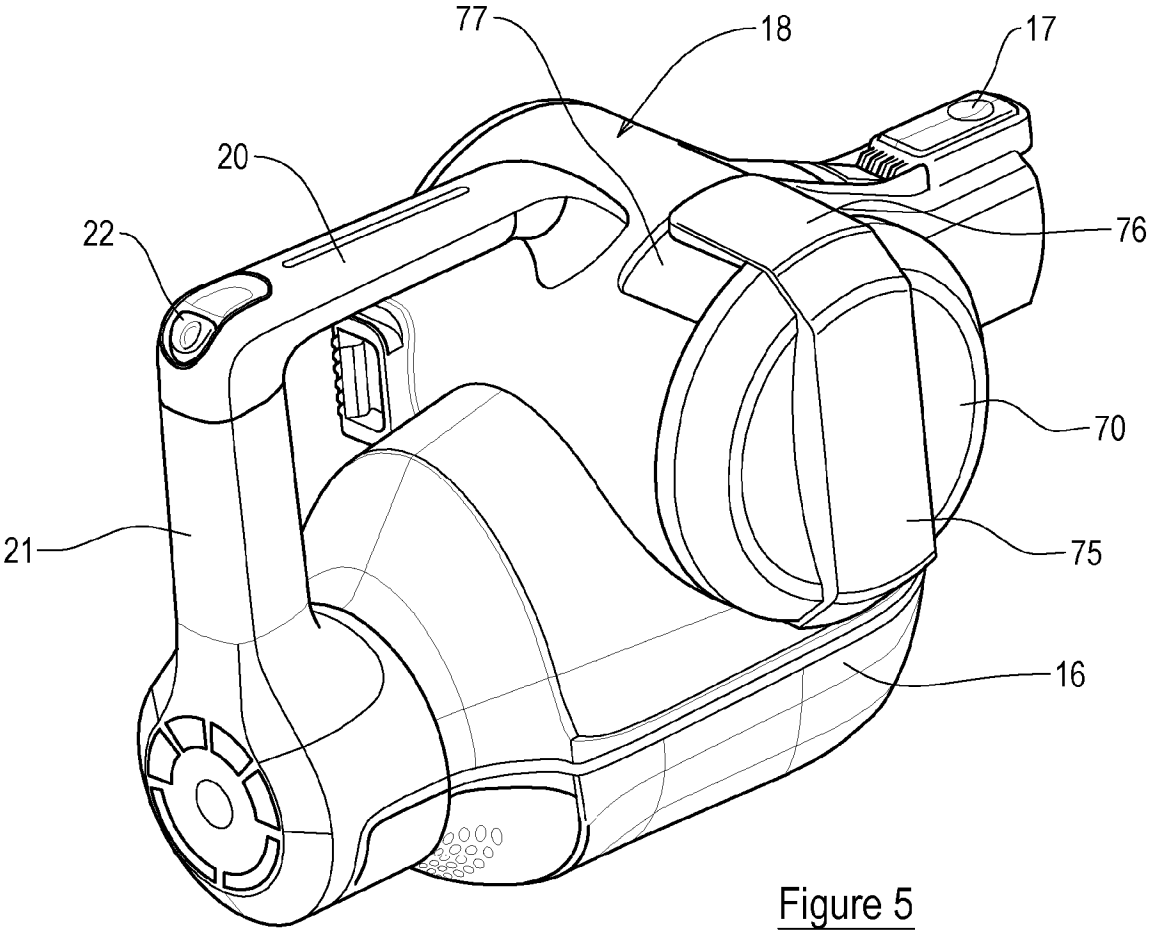
FIG. 5 is a perspective view of a housing of the apparatus of FIG. 1, which housing is operable as a handheld surface cleaning apparatus.
Figure 6:
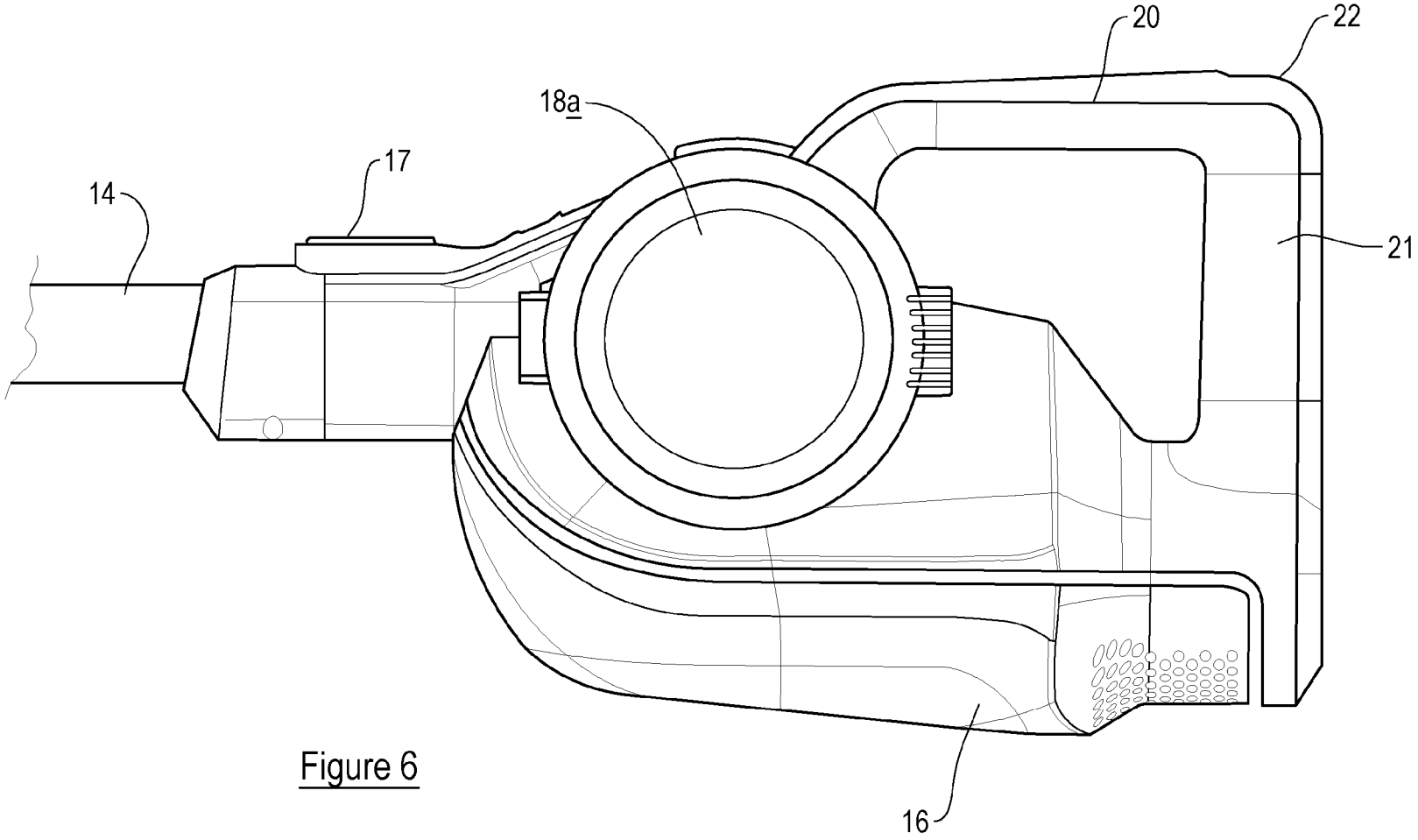
FIG. 6 is a side view of the housing of FIG. 5.
Figure 7:
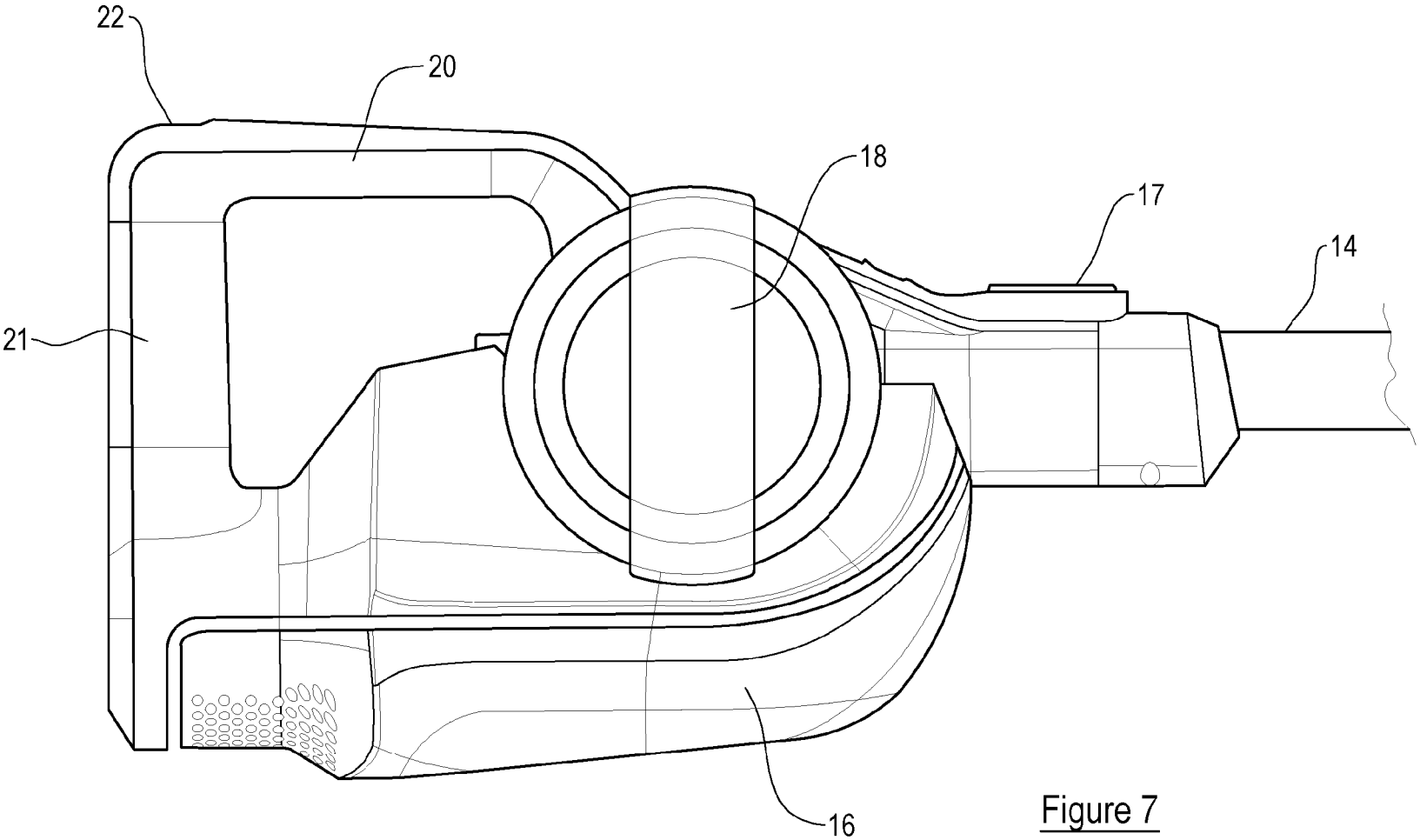
FIG. 7 is an opposite side view of the housing of FIG. 5.
Figure 8:
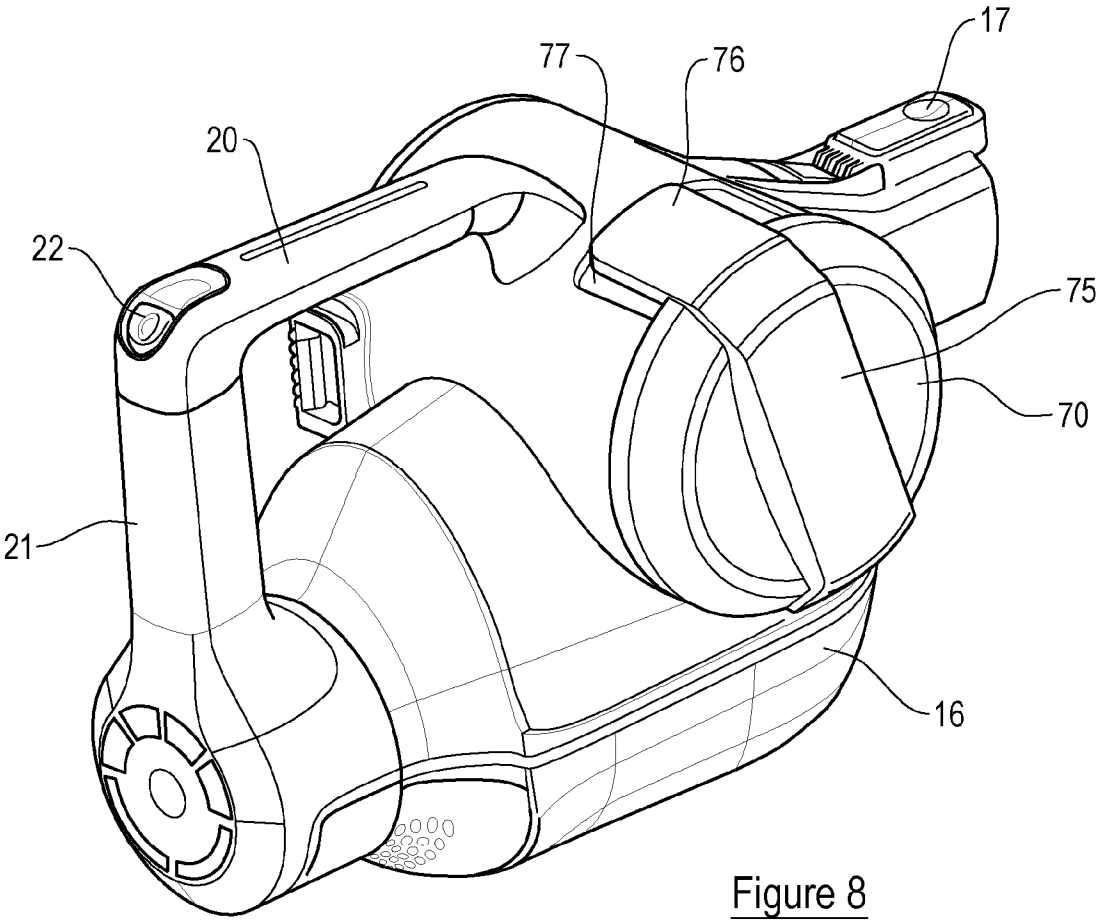
FIG. 8 further perspective view of the housing of FIG. 5.

An exterior surface of the ducting member 70 includes a formation 75 for assisting the user in grasping the ducting member 70 for rotating it between its locked and unlocked positions. The formation 75 extends diametrically over the axially outwardly facing surface of the ducting member 70 and includes a formation 76 which extends over an exterior surface 77 of the dirt collection container 18. The formation 76 acts as a visual indicator to a user as to whether the ducting member 70 is in its locked or unlocked position. The visual indicator formation 76 is received in a receiving formation bound by upwardly projecting walls 78, 79 provided on the exterior surface of the dirt collection container 18. The closed condition of the ducting member 70 corresponds to when the formation 76 is closer to the wall 79 than the wall 78 (see FIG. 5). Likewise, the open condition of the ducting member 70 corresponds to when the formation 76 is closer to the wall 78 than the wall 79 (see FIG. 8).

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A surface cleaning apparatus comprising:

a housing supporting a suction source;

a dirt collection container; and a cyclonic separation device for separating dirt from the airflow passing through the apparatus, the cyclonic separation device having an elongate axis about which dirt-laden air rotates; and a ducting member having an inlet in communication with an outlet from the cyclonic separation device and an outlet in communication with a passage leading to the suction source, wherein the ducting member is removably connected to the housing or the dirt collection container and is rotatably moveable about the elongate axis of the cyclonic separation device between locked and unlocked positions, and wherein rotational movement of the ducting member from its unlocked position to its locked position aligns the outlet of the ducting member with the passage leading to the suction source.

2. An apparatus according to claim 1 wherein the ducting member has a peripheral wall with the outlet thereof positioned in said peripheral wall.

3. An apparatus according to claim 1 wherein the ducting member includes a passage connecting its inlet to its outlet.

4. An apparatus according to claim 1 wherein the ducting member is substantially cylindrical.

5. An apparatus according to claim 1 wherein the ducting member is received in an end of the dirt collection container.

6. An apparatus according to claim 1 wherein the ducting member includes one or more seals for providing an air-tight seal between the ducting member and the dirt collection container or housing.

7. An apparatus according to claim 1 wherein the ducting member supports a pre-suction source filter.

8. An apparatus according to claim 1 wherein the ducting member includes a formation for assisting a user in grasping the ducting member for rotating it between its locked and unlocked positions.

9. An apparatus according to claim 1 wherein an end of the dirt collection container opposite the ducting member is covered by a closure member which can be moved between open and closed positions in order to empty the container of collected dirt.

10. An apparatus according to claim 1 wherein an elongate axis of the dirt collection container is substantially horizontal in normal use.

11. An apparatus according to claim 1 wherein the housing includes or is connected to a handle for holding the apparatus.

12. An apparatus according to claim 1 wherein the elongate axis of the cyclonic separation device is substantially horizontal in normal use.

13. An apparatus according to claim 12 wherein an elongate axis of the dirt collection container and the elongate axis of the cyclonic separation device are parallel with each other.

14. An apparatus according to claim 1 wherein the ducting member includes a formation which extends over an exterior surface of the dirt collection container or housing, said formation acting as a visual indicator to a user as to whether the ducting member is in its locked or unlocked position.

15. An apparatus according to claim 14 wherein the visual indicator formation extends over an upwardly facing surface of the dirt collection container or housing.

16. An apparatus according to claim 14 wherein the visual indicator formation is received in a receiving formation provided in the exterior surface of the dirt collection container or housing.

17. An apparatus according to claim 1 wherein the apparatus includes a floor head and an elongate member connecting the floor head to the housing, said elongate member including a passage for carrying dirt-laden air from the floor head to the dirt collection container.

18. An apparatus according to claim 17 wherein the elongate member is disconnectable from the floor head.

19. An apparatus according to claim 17 wherein the elongate member is disconnectable from the housing.

20. An apparatus according to claim 17 wherein the housing is operable as a handheld surface cleaning apparatus when the elongate member and floor head are disconnected therefrom.

21. A surface cleaning apparatus comprising:

a housing supporting a suction source;

a cylindrical dirt collection container defining an elongate axis extending centrally through the cylindrical dirt collection container; and a separation device for separating dirt from the airflow passing through the apparatus; and a ducting member having an inlet in communication with an outlet from the separation device and an outlet in communication with a passage leading to the suction source, wherein the ducting member is removably connected to the housing, wherein when the ducting member is connected to the housing, a portion of the ducting member is received within the cylindrical dirt collection chamber and the elongate axis extends through the ducting member and the ducting member is rotatably moveable about the elongate axis of the cylindrical dirt collection container between locked and unlocked positions, and wherein rotational movement of the ducting member from its unlocked position to its locked position aligns the outlet of the ducting member with the passage leading to the suction source.

22. The surface cleaning apparatus of claim 21, wherein the ducting member is removably connected to the housing by a bayonet fitting.

23. The surface cleaning apparatus of claim 21, wherein the ducting member is removable along the elongate axis.

24. A surface cleaning apparatus comprising:

a housing supporting a suction source;

a dirt collection container; and a cyclonic separation device for separating dirt from the airflow passing through the apparatus, the cyclonic separation device having a first axis about which dirt-laden air rotates; and a ducting member removably coupled to the housing and having an inlet in communication with an outlet from the cyclonic separation device and an outlet in communication with a passage leading to the suction source, wherein the ducting member is rotatably moveable about a second axis, the second axis parallel to the first axis, and wherein rotational movement of the ducting member aligns the outlet of the ducting member with the passage leading to the suction source.

25. The surface cleaning apparatus of claim 24, wherein the ducting member is removably coupled to the housing by a bayonet fitting.

26. The surface cleaning apparatus of claim 24, wherein the ducting member is rotatable between a locked position and an unlocked position.

27. The surface cleaning apparatus of claim 26, wherein the outlet of the ducting member is aligned with the passage leading to the suction source when the ducting member is in the locked position.

28. The surface cleaning apparatus of claim 26, wherein the ducting member is removable from the housing along the second axis in the unlocked position and is prevented from being removed along the second axis in the locked position.

* * * * *